US008356507B2

(12) United States Patent
Bauer et al.

(10) Patent No.: US 8,356,507 B2
(45) Date of Patent: Jan. 22, 2013

(54) METHOD AND DEVICE FOR MANUFACTURING PIPE CONNECTORS

(75) Inventors: Walter Bauer, Simmozheim (DE); Manfred König, Attendorn (DE); Bernd Koschig, Attendorn (DE)

(73) Assignee: Witzig & Frank GmbH, Offenburg (DE)

( * ) Notice: Subject to any disclaimer, the term of this patent is extended or adjusted under 35 U.S.C. 154(b) by 1146 days.

(21) Appl. No.: 12/154,036

(22) Filed: May 19, 2008

(65) Prior Publication Data

US 2008/0302164 A1 Dec. 11, 2008

(30) Foreign Application Priority Data

May 24, 2007 (DE) ..... 10 2007 024 357

(51) Int. Cl.
*B21D 41/02* (2006.01)
*B21C 37/15* (2006.01)

(52) U.S. Cl. .... 72/370.1; 72/370.06; 72/393; 72/370.24

(58) Field of Classification Search ..... 72/370.01, 72/370.03, 370.06, 370.1, 348, 349, 276, 72/285, 370.14, 370.23–370.25, 367.1, 393, 72/370.04, 381, 394
See application file for complete search history.

(56) References Cited

U.S. PATENT DOCUMENTS

| | | | | |
|---|---|---|---|---|
| 2,367,492 | A * | 1/1945 | Fickett et al. | 409/147 |
| 2,506,657 | A | 5/1950 | Webster | |
| 4,297,867 | A * | 11/1981 | Masaki et al. | 72/370.06 |
| 2007/0256467 | A1 | 11/2007 | Viegner et al. | |

FOREIGN PATENT DOCUMENTS

| | | |
|---|---|---|
| DE | 43 36 261 | 4/1995 |
| DE | 100 31 989 | 1/2002 |
| DE | 10 2005 014 940 | 11/2006 |
| EP | 1 321 704 | 12/2002 |
| FR | 2 829 408 | 9/2001 |
| JP | 56-128629 | 10/1981 |
| JP | 63144827 A * | 6/1988 |
| WO | WO 2005/061148 | 7/2005 |

* cited by examiner

*Primary Examiner* — Dana Ross
*Assistant Examiner* — Pradeep C Battula
(74) *Attorney, Agent, or Firm* — Cozen O'Connor

(57) ABSTRACT

Devices and methods for manufacturing fittings (2) with different ends (3, 4) are disclosed, such fittings permitting different measures of connection. For example, one fitting (2) is a threaded end connector with its one end (4) being potentially configured as a compression fitting and its other end (3) as a thread-bearing end. An intermediate section (5) having preferably a polygonal cross-section is provided between the two ends (3, 4). Starting with a pipe piece (1), the manufacture takes place in a few process-safe method steps.

21 Claims, 4 Drawing Sheets

F
1
5
6
7
8
9
10
11
12
13
14
15
16
17
18
19
20
21
22
22a
23
24
25

2
33
3
5
4

2
5

39
7
F
42
38

40
39
32
26
30
27
F
7
41
38
31
29

35
37
36
34
26
30
5
27
32
7
F
33
6
28
31
29

23
F
6
5
9
11
7

19
F
23
25
9
6
11

14
F
16
17
43
13
9
5
6
11
12
7
1

6
8
7

1

METHOD AND DEVICE FOR MANUFACTURING PIPE CONNECTORS

RELATED APPLICATION

This application claims the priority of German application no. 10 2007 024 357.1 filed May 24, 2007, the entire content of which is hereby incorporated by reference.

FIELD OF THE INVENTION

The invention relates to a method and a device for manufacturing pipe connectors, fittings and the like, in particular, for threaded end connectors.

BACKGROUND OF THE INVENTION

Fittings are mass-produced items that can be manufactured in large numbers in a highly efficient manner. Cutbacks on quality, however, are not acceptable. This requires high-quality machine engineering, mold construction and process technology. In practice, "pipe connectors" are referred to as fittings which comprise a threaded end and an end that is designed for a compression-type connection.

For example, a method for manufacturing fittings of stainless steel has been known from document DE 100 31 989 A1. This method uses a matrix into which is placed a piece of piping in the form of a blank and also uses a compression mandrel into which the pipe end is pressed in order to expand the pipe end. In so doing, the pipe wall is stretched in the peripheral direction. Furthermore, a shoulder provided on the mandrel exerts an axial pressure on the front-side end of the pipe piece, so that the pipe wall is compressed in the axial direction. By means of this process, an annular bead is produced all around the pipe wall, whereby an O-ring may be placed as a seal in said bead.

Another method for the production of compression fittings, preferably consisting of copper, has been known from document DE 43 36 261 A1. This literature reference discloses a multi-step method whereby a pipe piece is placed as a blank into a divided matrix. The thusly held blank is compressed in the axial direction by means of a mandrel and is optionally somewhat widened. An annular material bead is formed all around the pipe wall of the pipe. During a subsequent step, the elevated or recessed bead is rolled from the inside with a roller moving on an orbital path in order to form a smooth perfect seat for an O-ring.

The main feature of the previously known methods was the production of fittings with a seat for an O-ring. In so doing, the fittings featured on their two ends, respectively, the same connecting technology, i.e., respectively one O-ring seat and one compression region for the connection of a pipe. However, the pipe wall is so thin that no conventional thread may be applied if a threaded end connector is to be produced.

Document DE 10 2005 014 940 A1 discloses a fitting with a threaded end connector and a compression connector that is produced by a reforming process. The greater wall thickness for the threaded end connector is produced by compression. In this case, the thread must be produced on the axially compressed material.

SUMMARY OF THE INVENTION

One object of the present invention is to provide a robust and highly efficient production method for manufacturing fittings that use different connecting technologies on each of their two opposite ends.

Another object of the invention is the manufacture of fittings having a section with a non-circular cross-section.

These and other objects are attained in accordance with one aspect of the present invention directed to a method, wherein the pipe piece used as the blank is placed in a mold or matrix and fixed in place therein. Thereafter, a section of the pipe piece is widened by means of a mandrel in any appropriate sequence. An existing profile of the pipe piece can be removed and a not existing profile of the pipe piece can be produced, and (before or after) a drawing device is placed on the pipe end. With the use of the drawing device, a drawing operation is performed on the pipe end, in the course of which the pipe end is stretched in the axial direction. As a result of this, a reduction of the wall thickness is achieved. An intermediate blank having two ends with different wall thicknesses is obtained.

In this manner, the pipe pieces can be reformed into a product that has a first end with a larger wall thickness, a second end with a smaller wall thickness and, in between, a profiled, e.g., octagonal or hexagonal section. Different connecting technologies may be implemented on the two pipe ends. For example, the pipe end having the thicker wall may be provided with an external thread, an internal thread or another connecting means that requires a thicker wall. The thinner-walled pipe end may be provided with another connecting means such as, for example, an annular bead, into which is placed an O-ring, whereby the pipe end must then be handled like a compression fitting. However, a soldered connection may also be used. Other connecting technologies that rather prefer thin-walled pipe ends may also be applied.

Preferably, the widening of the pipe end occurs in two partial steps. To do so, two different forming mandrels are used. During a first widening step, the first forming mandrel is used to widen the pipe end to a small diameter. In so doing, a profile may be produced in the intermediate section of the pipe piece. For example, the profile may be a hexagonal, octagonal or other profile. This may be produced in the final dimensions. The pipe end adjoining the profiled region, however, is preferably widened to a desired dimension. If the blank used as the pipe piece already had an initial profile, this profile may be eliminated during the widening operation. The cross-section of the pipe end is then round in each case, independent of any existing initial profile.

The profile in the intermediate section that is produced (or obtained) and the widening of the pipe end preferably occur in a matrix that encloses the outside of the profiled region of the pipe end. This part of the matrix is preferably configured in two or more elements, said elements being supported in a manner so as to be movable, e.g., radially adjustable.

A further method step is a drawing operation to be performed on the pipe end. In order to perform this drawing operation, a drawing device is attached to the pipe end. The drawing device preferably comprises a draw ring enclosing the pipe end on the outside and a mandrel. The mandrel that may be used, for example, may be the widening mandrel using during the widening step. If the widening step is done in two steps, the forming mandrel used for the second widening step can be used as a part of the drawing device.

During the drawing operation, the wall thickness of the pipe end is reduced. This wall thickness may be reduced to a suitable dimension, for example, for the formation of a compression fitting. Additional machining steps may follow such as, for example, the face-turning of the end face of the pipe end, the application of one or more annular beads for the accommodation of O-rings or other elements, etc.

Now the process is continued on the second pipe end, which preferably is to retain a greater wall thickness. The pipe end may be widened with another mandrel in that said pipe end is placed in the matrix which that is in intimate contact with the outside of the pipe end. If a conical thread is to be applied to the pipe end, the pipe end may be compressed in radial direction in order to attain a conical basic shape. In so doing, the pipe end, if necessary, may be supported from the inside by one or more movable mold parts.

If the blank initially had a polygonal cross-section, the polygonal form may be eliminated by the widening step in order to thus impart the pipe end with a circular cross-section.

The formation of the desired shape of the pipe end may be followed by another machining step, for example, face-turning, during which the face of the pipe end is turned to be smooth. During additional machining steps, the outside surface of the pipe may be provided with an external thread by cutting or rolling or in another manner.

If the pipe ended has been widened in a conical manner, it is also possible to apply a conical inside thread.

If the pipe end is cylindrical, an inside and/or outside thread may be applied. In addition, grooves or flanges may be provided as a seat for seals or other sealing means.

Additional modifications are possible. Additional advantageous details of the invention are obvious from the drawings, the description or the claims. The description and the drawings are restricted to essential aspects of the invention and to miscellaneous situations. The drawings supplement the description in the usual manner.

BRIEF DESCRIPTION OF THE DRAWINGS

The drawings show exemplary embodiments of the invention. They show in

DETAILED DESCRIPTION OF THE DRAWINGS

Figures 1, 2, 3, 4, 5:
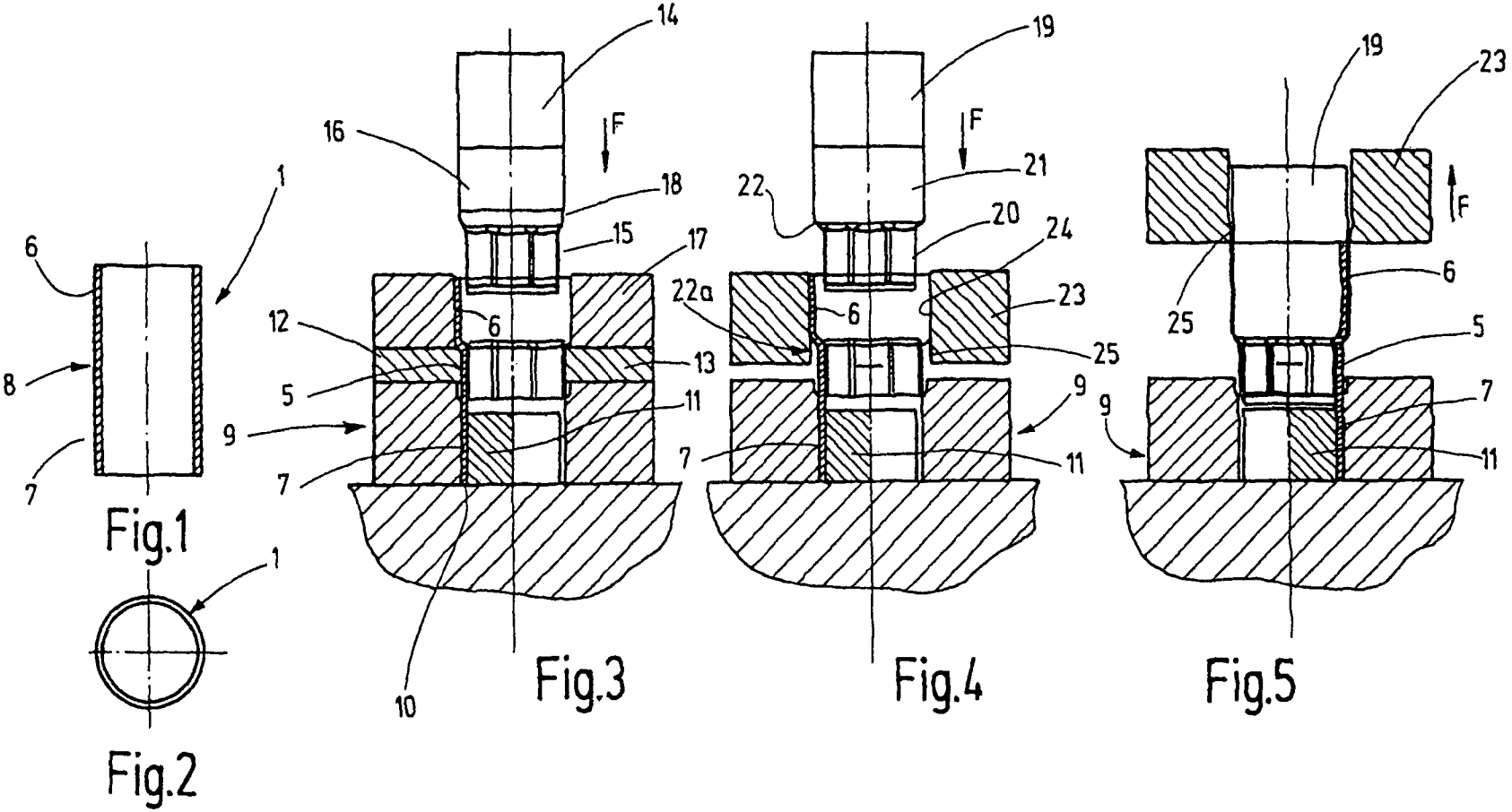
FIG. 1 a longitudinal sectional view of a pipe piece as a blank which is used to produce a fitting.
FIG. 2 a plan view of the blank in accordance with FIG. 1.
FIG. 3 a longitudinal sectional view of a matrix with associate widening mandrel after a first widening step has been carried out.
FIG. 4 a longitudinal sectional view of the matrix and a drawing device, as well as a second widening mandrel after the second widening step has been carried out.
FIG. 5 the device in accordance with FIG. 4 while a drawing operation is being performed.
Figures 6, 7, 8, 9, 10:
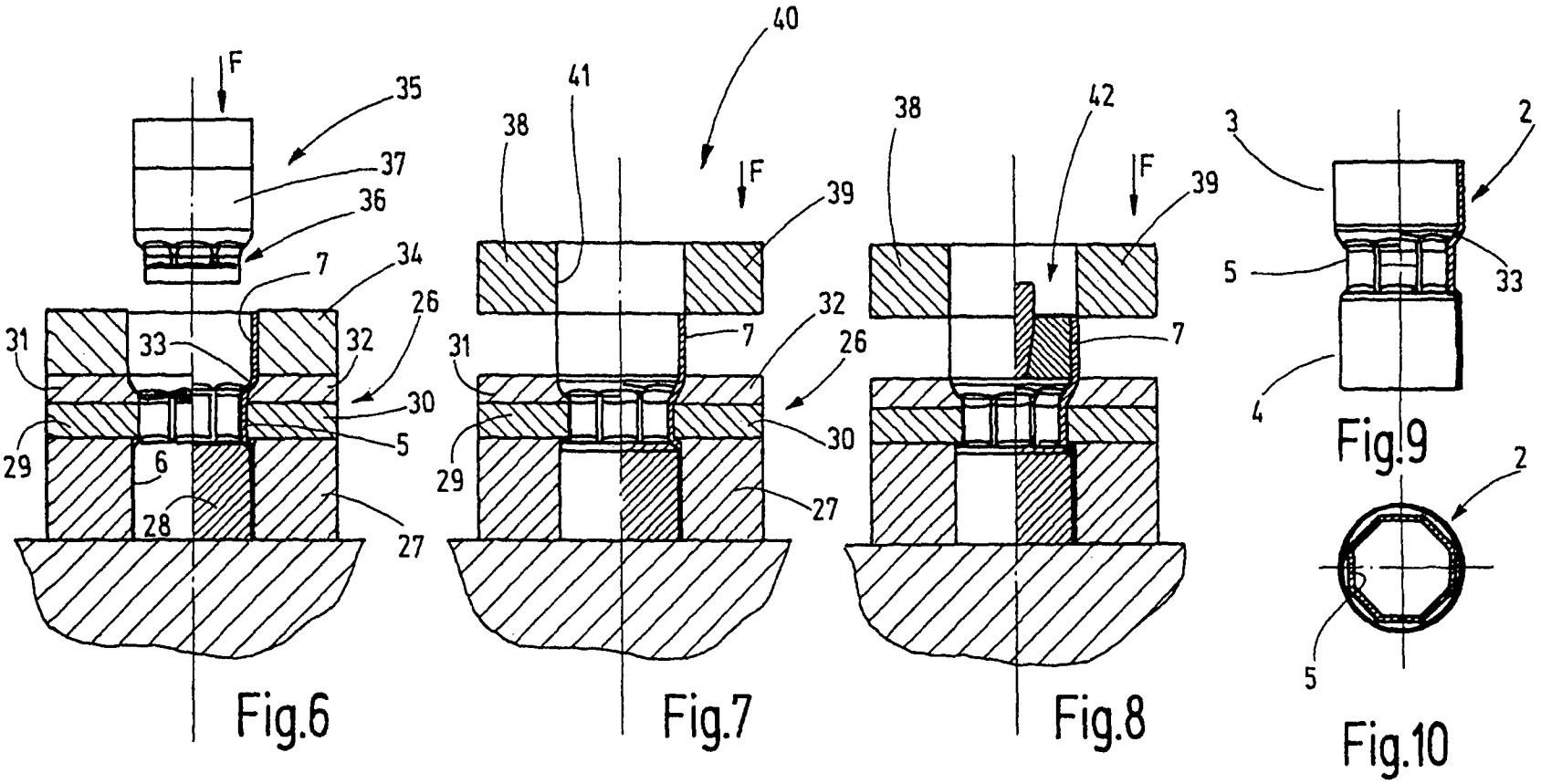
FIG. 6 a matrix and the intermediate blank, as well as a forming mandrel for widening the second pipe end.
FIG. 7 a longitudinal sectional view of a matrix and a slider for converting the pipe end into a conical form.
FIG. 8 a longitudinal sectional view of an embodiment that represents an alternative to the device in accordance with FIG. 7.
FIG. 9 a side view, partially in section, of the largely completely machined fitting.
FIG. 10 a plan view of the fitting in accordance with FIG. 9.

FIG. 1 shows a pipe piece 1 that is used to produce the fitting 2 shown by FIG. 9. As is shown by FIG. 2, the pipe piece 1 has an originally circular cross-section. As opposed to this, the fitting 2 has two differently configured ends 3, 4 and an interposed polygonally delimited intermediate section 5. The latter, as shown by FIG. 10, may have an octagonal cross section or even a cross-section that is different therefrom. The ends 3, 4 are derived from the pipe ends 6, 7 of the pipe piece 1. Between the pipe ends 6, 7 is a section 8 which is reformed into the polygonal intermediate section 5. The section 8 and the pipe ends 6, 7 preferably have matching diameters and cross-sections.

In order to perform the reforming operation, e.g., a device is used which comprises the components shown by FIGS. 3, 4, 5, 6 and, alternatively, 7 or 8. A first reforming step is performed in FIG. 3. To do so, a matrix 9 is provided, said matrix having a central bore for the accommodation of the pipe end 7 and, in addition, for the support of the front side 10 of the pipe end 7. The matrix 7 may also comprise a core 11 that is seated in the bore of the matrix and supports the pipe end 7 from the inside.

Additional forming elements 12, 13 delimiting a polygonal cross-section are provided above the matrix. This polygonal cross-section preferably matches the desired exterior form of the intermediate section 5. The forming elements 12, 13 are preferably adjustable in radial direction. Two, three or more correspondingly interacting forming elements may be provided, said elements being connected to each other by means of not specifically shown adjustment devices.

A widening mandrel 14, which is divided into several sections, is used for widening the pipe end 6 and for shaping the section 8. A first section 15 has a cross-section that corresponds to the inside cross-section of the elements 12, 13, whereby, however, it has a size that has been reduced by the wall thickness of the intermediate section 5. In the present example, the section 15 is octagonal. Adjoining the section 15 is another, preferably slightly conical, section 16 that is used for widening the pipe end 6. On the outside, the pipe end 6 is enclosed by an annular matrix part 17 which has a cylindrical opening for this purpose. Between the sections 15 and 16 is a transition section 18 which forms a rounded transition between the sections 15, 16.

The device in accordance with FIG. 4 is provided to carry out a second method step. This device comprises a matrix 9 that may be (but need not be) identical to the matrix 9 of FIG. 3. Again, it contains a core 11 in order to secure the pipe end 7 and to prevent said pipe end from collapsing toward the inside. A widening mandrel 19 is provided for carrying out the second widening step, said mandrel again having a polygonal section 19 and an almost cylindrical section 21 (larger diameter). A relatively steep shoulder 22 is provided between the two sections 20, 21 in order to bring the fitting to be produced into its final shape in the appropriate region.

Instead of the matrix part 17, now a draw ring 23 is positioned over the pipe end 6. The draw ring 23 has an opening 24 which is essentially cylindrical or slightly conical. Its lower end is formed by a ring surface 25 having a diameter that is slightly greater than the diameter of the section 21 of the widening mandrel 19. The wall thickness of the pipe end 6 existing after the widening process, however, is greater than the diameter difference between the section 21 and the ring surface 25. Considering this, a step 22*a* indicated in FIG. 4 is provided between the ring surface 25 and the remaining opening 24.

FIG. 6 shows another matrix 26 for the continuation of the manufacturing process with the second pipe end 7. The matrix 26 is composed of several elements. A lower annular part 27 has a cylindrical opening having the diameter of the first pipe end 6. A core 8 may be placed in the inside space of the pipe end 6, said core supporting the pipe end 6 in inward direction and preventing said pipe end from collapsing due to the action of axial pressure.

The intermediate section 5 may be enclosed by several adjustably supported matrix parts 29, 30 having an inside shape that is adapted to the intermediate section 5 in order to evenly abut against said section. Additional matrix parts 31, 32 may enclose a transition region 33 of the fitting 2 in order to support said fitting. An upper matrix part 34 supports the pipe end 7 toward the outside and, for this purpose, has a cylindrical passage opening of appropriate diameter.

The device in accordance with FIG. 6 is associated with a widening mandrel 35 that has a lower section 35. Said section is adapted to the inside form of the polygonal intermediate section 5. Adjoining this, via a rounded shoulder, is an essentially cylindrical or slightly conical section 37 which is disposed to widen the pipe end 7.

To continue the forming process in accordance with the invention, the device may be constructed as is obvious from FIG. 7. Again, the pipe end 6 is enclosed by a part 27 of a matrix 26 which also comprises matrix parts 29 through 32. These elements may be the same as in FIG. 6. However, it is also possible to transfer the pipe piece from the matrix 26 as in FIG. 6 into the same or a similarly configured matrix as in FIG. 7. However, the upper matrix part 34 is missing, so that the pipe end 7 extends freely from the matrix 26. Now the elements 38, 39 of a pushing device 40 may act on the outside of the pipe end 7 in order to apply a radially inward force on said pipe end. The elements 38, 39 may be sliders, fingers or the like that can be moved in radial direction and are connected with a drive device, said elements contacting in particular the upper edge of the pipe end 7. Furthermore, it is possible to combine the elements 38, 39 to form a ring that has a conical passage opening 41. By pressing the ring onto the pipe end 7, said pipe end is reformed to produce the appropriate cone.

As is shown by the modification in accordance with FIG. 8, it is also possible and practical in many cases to support the pipe end 7 from the inside by means of a mandrel 42 when the ring 38, 39 is pushed onto the pipe end 7. This mandrel may consist of several movably supported elements that can be adjusted in radial direction. As a result of this, the diameter of the mandrel 42 can be changed in order to initially widen it in the inside space of the pipe end 7 and to then convert the pipe end 7 with the ring 38, 39 into a conical shape. Thereafter, the diameter of the mandrel 42 may again be reduced and the mandrel may be retracted from the pipe end 7.

The function of the device described so far is as follows:

In order to produce the fittings 2, the pipe piece 1 is set into the matrix 9 in accordance with FIG. 3. With the use of the widening mandrel 14 the pipe end 6 is widened and the intermediate section 5 is converted into the polygonal form. This is achieved in that the mandrel 14 is moved in the direction of the arrow F into the pipe end 6 and the section 8, and then retracted again therefrom.

After this first widening step, the forming elements 12, 13 and the matrix part 17 are removed. Now the draw ring 23 is moved over the pipe end 6. The diameter of said pipe is slightly smaller than the diameter of the ring surface 25, so that the draw ring 23 fits over the pipe end 6. Then, during a second widening step, the widening mandrel 19 is moved into the pipe end 6, which is further widened as a result of this. Now said pipe end's diameter is greater than the inside diameter of the ring surface 25. This situation is shown by FIG. 4.

During a subsequent step, as shown by FIG. 5, the drawing operation takes place. For this step it is required that the pipe end 7 be clamped between the core 11 and the annular lower part of the matrix 9, or be otherwise secured against any axial pull. While the widening mandrel 19 is still seated in the pipe end 6 and the intermediate section 5, the draw ring 23 is moved in axial direction (upward in FIG. 5). Now the wall thickness of the pipe end 6 is reduced by means of the ring surface 25. In so doing, the pipe end 6 expands in axial direction. FIG. 5 shows the end of this drawing process.

In this stage, an intermediate blank is produced, said blank having two pipe ends 6, 7 exhibiting different wall thicknesses. In some individual cases the intermediate blank may already be sufficiently machined. In most cases, however, additional machining steps are required. For example, it may be necessary that the upper edge, i.e., the end face of the pipe end 6, be smoothed, e.g., by face-turning. This process is not specifically illustrated.

FIG. 6 shows additional machining steps that may be performed on the pipe end 7. For example, it may be important to further widen said pipe end. To achieve this, the matrix part 34 is pushed onto the pipe end 7 and is widened by means of a widening mandrel 35. The matrix part 34 may comprise one or more elements. Multi-element matrix parts may also be moved in radial direction.

For example, if a conical thread is to be applied to the pipe end 7, the pipe end 7, as shown by FIG. 7, is first converted into the conical form. This is done, for example with a matrix part that consists of a closed ring or individual elements 38, 39. FIG. 7 shows the elements 38, 39 combined to form a ring which is pressed onto the pipe end 7 in the direction of the arrow F. Its passage opening 41 stamps the conical form onto the pipe end 7.

Alternatively, the pipe end 7 may be supported on the inside by the mandrel 42 during this operation, as illustrated by FIG. 8. In so doing, it is also possible to widen the pipe end 7 in a conical manner.

After this step has been carried out the face end of the pipe end, can be face-turned or smoothed otherwise, if necessary. In addition, the fitting 2 may be provided with other forms, for example, in that the pipe end 7 is provided with a conical outside thread. Then the production of the fitting 2 is complete.

Figures 11, 12, 13, 14, 15:
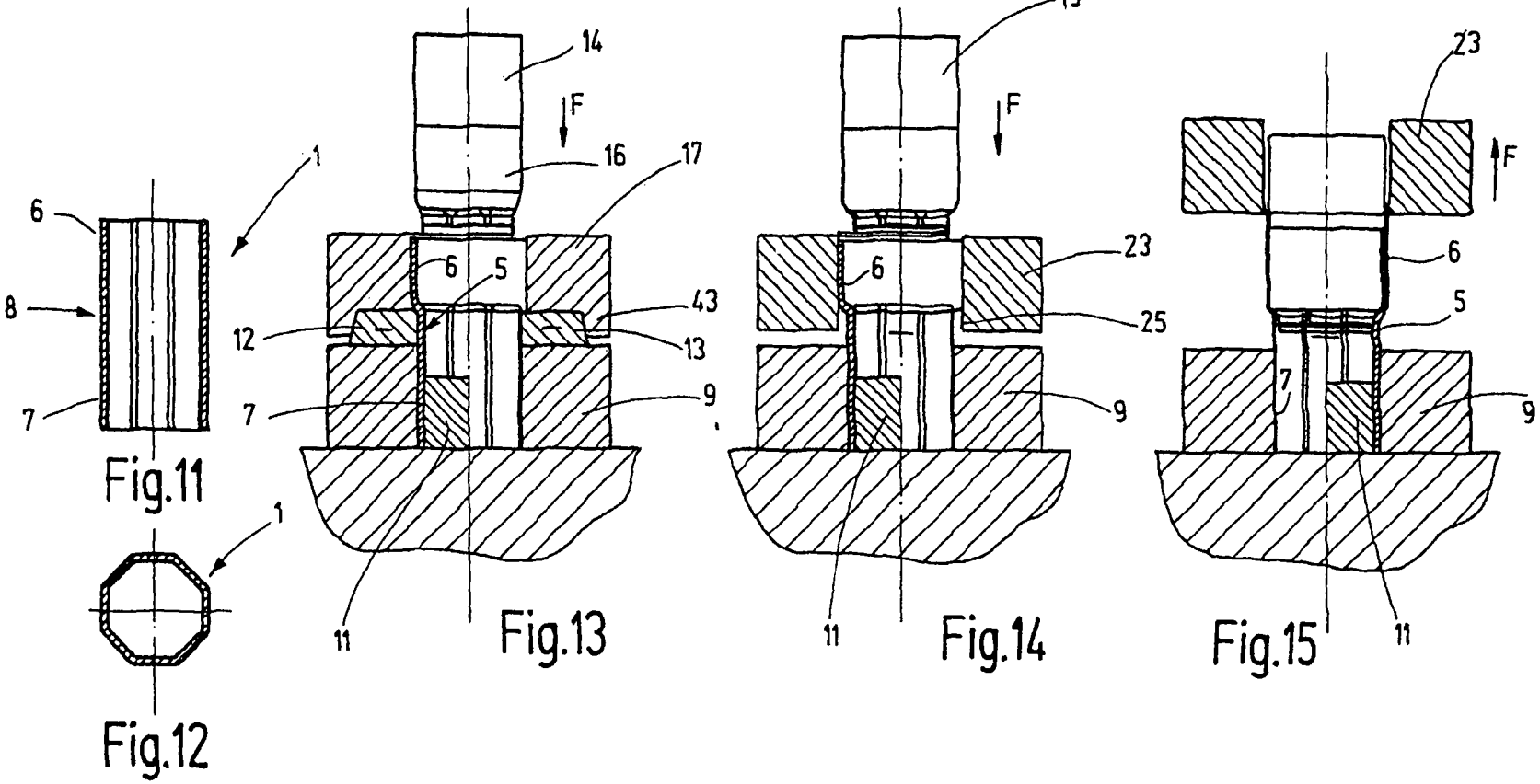
FIG. 11 a longitudinal sectional view of an octagonal rectangular pipe as a blank for an alternative embodiment of the inventive method.
FIG. 12 a plan view of the blank in accordance with FIG. 11.
FIG. 13 a longitudinal sectional view of a matrix, a widening mandrel and the blank after the first method step has been carried out.
FIG. 14 the matrix, a second widening mandrel and a drawing device, in addition to a blank after the second widening step has been carried out.
FIG. 15 a longitudinal sectional view of the matrix, the blank and the drawing device after the drawing operation has been carried out.
Figure 19:
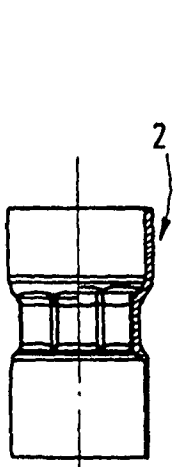
FIG. 19 a side view, partially in section, of the largely finished fitting; and, FIG. 20 a plan view of the fitting in accordance with FIG. 19.
Figure 20:
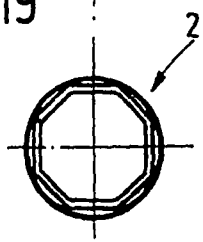

FIGS. 13 through 18 show an alternative embodiment of the device for carrying out the method on a pipe piece 1 having a polygonal cross-sections as is shown by FIGS. 11 and 12. Considering the device in accordance with FIGS. 13 through 18 and the fitting 2 in accordance with FIGS. 19 and 20, the statements of the previous descriptions apply with reference to the already given reference numbers. The following is considered supplementary:

The matrix 9 has a polygonal opening which is adapted to the polygonal form of the pipe end 7. Likewise, the core 11 has a polygonal cross-section. In contrast, the matrix part 17 has a preferably cylindrical bore for the accommodation of the pipe end 6 that is to be widened. On its underside, it may be provided with a collar 43 which supports the forming elements 12, 13 radially toward the outside. The corresponding abutment surfaces of the forming elements 12, 13 and the collar 43 may be arranged at an angle relative to the longitudinal center axis of the matrix 9 and the pipe piece 1, so that an axial approach movement of the matrix part 17 clamps the forming elements 12, 13 radially inward against the profiled intermediate section 5.

The widening mandrel 14 is moved into the pipe end 6 and widens said pipe end, whereby its section 16 eliminates the profile. However, said profile is retained in the region of the intermediate section 5.

Thereafter, as is shown by FIG. 14, the draw ring 23 is pushed onto the widened pipe end 6. Then the pipe end 6 is widened by means of the second widening mandrel 19 to such a degree that its outside diameter exceeds the inside diameter of the ring surface 25. As is shown by FIG. 15, this is followed by the drawing step as has already been described in conjunction with FIG. 5. The matrix 9 and the core 11 may be the same for performing the steps in accordance with FIGS. 13 through 15, i.e., the steps may all take place in one station. The same applies in view of FIGS. 3 through 5.

Figure 18:
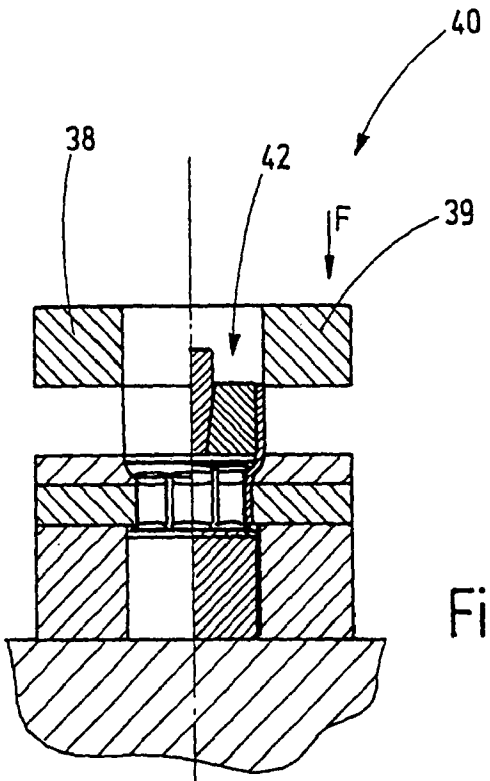
FIG. 18 a longitudinal sections view of an alternative embodiment of the device for carrying out the method step in accordance with FIG. 17.
Figure 17:
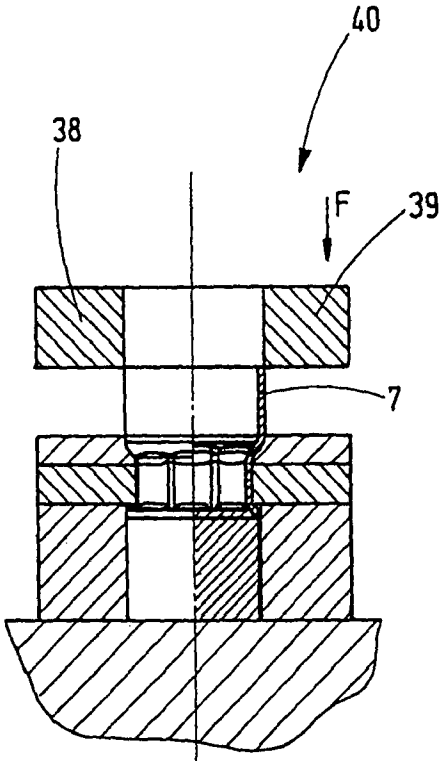
FIG. 17 a longitudinal sectional view of the principle of a matrix and slider elements for the conical tapering of the blank.
Figure 16:
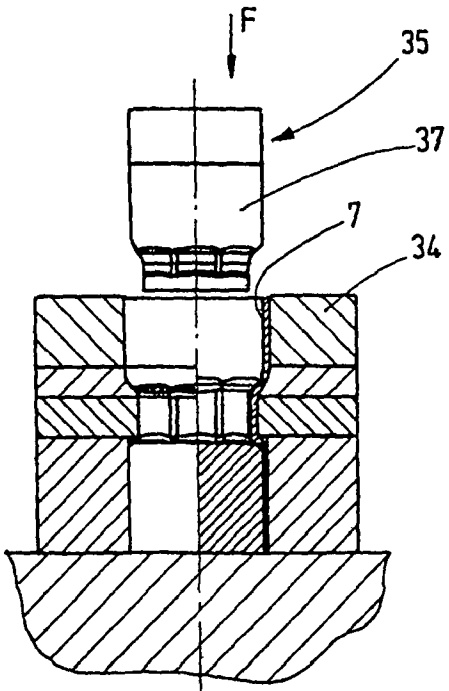
FIG. 16 a longitudinal sectional view of a matrix and a widening mandrel for widening the second pipe end after the widening step has been carried out.

Any further deformation of the pipe end 7 now takes place in accordance with FIGS. 16 through 18 in a manner that is similar to what has been previously described. However, a difference exists regarding the reformation of the pipe end 7 which, after the drawing step has been performed, initially still has a polygonal form. The widening mandrel 35 eliminates the polygonal form when it is moved into the pipe end 7. Its cylindrical or slightly conical section 37 pushes the pipe wall smoothly against the corresponding cylindrical or slightly conical wall of the matrix part 34. Then, as is shown by FIGS. 17 and 18, the pipe end 7 can be converted into a conical form, either with or without the internal support by the mandrel 42 (FIG. 18), this being achieved by respectively inserting the pushing device 40. The resultant fitting in accordance with FIGS. 19 and 20 corresponds to the fitting 2 in accordance with FIGS. 9 and 10.

Devices and methods for manufacturing fittings 2 with different ends 3, 4 have been shown, said fittings permitting different measures of connection. For example, the fitting 2 is a threaded end connector with its one end 4 being potentially configured as a compression fitting and its other end 3 as a thread-bearing end. An intermediate section 5 having preferably a polygonal cross-section is provided between the two ends 3, 4. Starting with a pipe piece 1, the manufacture takes place in a few process-safe method steps.

We claim:

1. A method for manufacturing pipe connectors, comprising:

inserting a pipe piece in a matrix;

inserting a core into the pipe piece, the core clamping a first pipe end of the pipe piece together with the matrix to secure the pipe piece against an axial movement;

widening a second pipe end of the pipe piece by a forming mandrel while forming or eliminating a profile of the pipe piece;

placing a drawing device onto the second pipe end; and performing a drawing operation on the widened second pipe end, wherein the forming mandrel has a section with a polygonal cross-section and a section with a round cross-section, and the pipe piece, on a polygonal intermediate section which is to receive or retain a polygonal cross-section, is supported in a forming section which has a nominal dimension of the polygonal intermediate section.

2. The method in accordance with claim 1, wherein, the widening of the second pipe end occurs in two partial steps.

3. The method in accordance with claim 2, wherein, during a first widening step with a forming mandrel, the pipe piece is widened to a fixed dimension that is smaller than the nominal dimension.

4. The method in accordance with claim 2, wherein, during a second widening step, the second pipe end is widened to the nominal dimension.

5. The method in accordance with claim 4, wherein the second widening step is performed inside the drawing device.

6. The method in accordance with claim 1, wherein the second pipe end is widened inside the drawing device before the drawing operation is performed.

7. The method in accordance with claim 1, wherein the first pipe end is stretched in an axial direction during the first drawing operation, whereby the wall thickness of said first pipe is being reduced.

8. The method in accordance with claim 1, wherein a second section of the pipe piece, which constitutes the second pipe end, is widened.

9. The method in accordance with claim 1, wherein a second section of the pipe piece, which constitutes the second pipe end, is converted into a conical form.

10. The method in accordance with claim 1, wherein a second section of the pipe piece, which constitutes the second pipe end, is provided with a thread.

11. The method in accordance with claim 1, wherein the pipe piece has a circular cross-section before the method is performed.

12. The method in accordance with claim 1, wherein the pipe piece has a polygonal cross-section before the method is performed.

13. A device for carrying out the method in accordance with claim 1, comprising:

a first matrix part (9) having an opening for the accommodation of a pipe piece (1), said opening having a diameter adapted to the pipe piece (1);

a second matrix part (12, 13) having a polygonal internal form through which extends the pipe piece (1);

at least one widening mandrel (14, 19) which is connected to a drive device in order to be axially moved into and out of the first pipe end (6) of the pipe piece (1) so as to widen said pipe end; and a drawing device (23) for axially stretching the pipe end (6) which had been widened by the widening mandrel (14, 19).

14. The device in accordance with claim 13, wherein the opening of the first matrix part (9) has a circular cross-section.

15. The device in accordance with claim 13, wherein the opening of the first matrix part (9) has a polygonal cross-section.

16. The device in accordance with claim 13, wherein the second matrix part (12, 13) is divided into at least two parts that are supported so as to be radially adjustable.

17. The device in accordance with claim 13, wherein at least two widening mandrels (14, 15), which are to be used in succession and have different sizes, are provided.

18. The device in accordance with claim 17, wherein the second widening mandrel (19) is associated with the drawing device (23).

19. The device in accordance with claim 13, wherein a draw ring (23) belongs to the drawing device, said draw ring being positioned around the outside circumference of the section of the pipe end (6) that is to be widened, while the widening mandrel is moved into the pipe end (6).

20. The device in accordance with claim 13, wherein the device comprises a matrix (26, 34) and a widening mandrel (35) for a second section of the pipe piece (1), said section constituting a second pipe end (7).

21. The device in accordance with claim 13, wherein the device comprises a pushing device (40) for converting the axially not stretched section of the pipe end (7) into a conical form.

* * * * *